US005816040A

United States Patent [19]

Stahlecker

[11] Patent Number: 5,816,040

[45] Date of Patent: Oct. 6, 1998

[54] OPEN END SPINNING ROTOR WITH WEAR RESISTANT SURFACE LAYER AND METHOD OF MAKING SAME

[75] Inventor: Fritz Stahlecker, Josef-Neidhart-Strasse 18, 73337 Bad Ueberkingen, Germany

[73] Assignees: Fritz Stahlecker, Bad Überkingen; Hans Stahlecker, Süssen, both of Germany

[21] Appl. No.: 613,987

[22] Filed: Mar. 8, 1996

[30] Foreign Application Priority Data

Mar. 17, 1995 [DE] Germany ..... 195 09 742.4

[51] Int. Cl.[6] ..... D01H 4/00

[52] U.S. Cl. ..... 57/414; 57/416

[58] Field of Search ..... 57/414, 404, 400, 57/416, 417, 401, 415

[56] References Cited

U.S. PATENT DOCUMENTS 4,663,929 5/1987 Raasch et al. .

FOREIGN PATENT DOCUMENTS 3429511 2/1986 Germany .
4305626 8/1994 Germany .

*Primary Examiner*—William Stryjewski
*Attorney, Agent, or Firm*—Evenson McKeown Edwards & Lenahan, PLLC

[57] ABSTRACT

An open end spinning rotor wherein the fiber guiding inner surface consists of a wear resistant surface layer of iron boride. The fiber guiding inner surface comprises a fiber sliding surface adjacent to a fiber collecting groove. The fiber collecting groove has a greater frictional resistance than the fiber sliding surface relative to the spinning fibers. This is achieved by means of a special structured surface of the fiber collecting groove. The structure surface of the fiber collecting groove can be created by a roughening of the boronized surface layer by means of a laser for instance, or alternatively, the structure can be created before the boron treatment by mechanical means such as roll pressing.

16 Claims, 3 Drawing Sheets

FIG. 1
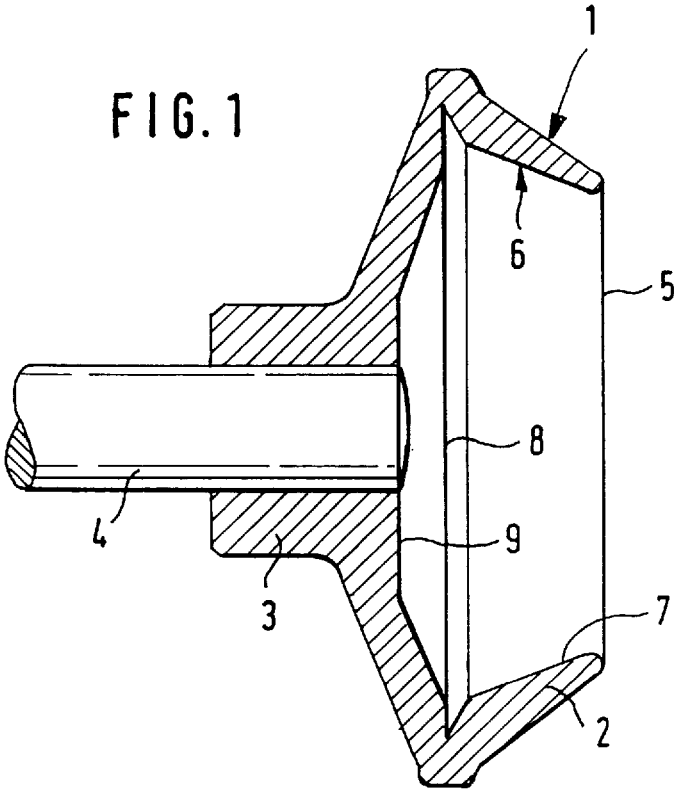
FIG. 2
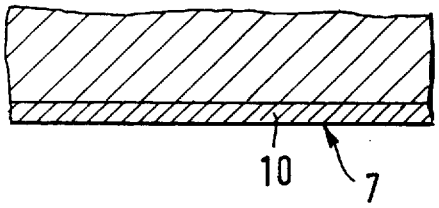
FIG. 3
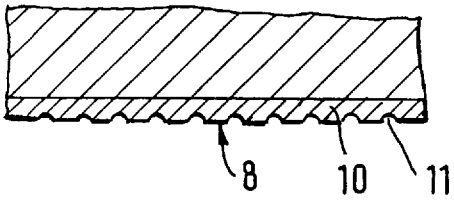
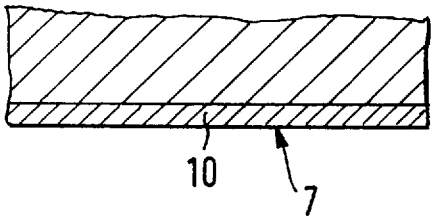
FIG. 4
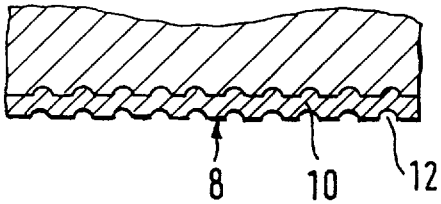
FIG. 5

OPEN END SPINNING ROTOR WITH WEAR RESISTANT SURFACE LAYER AND METHOD OF MAKING SAME

BACKGROUND AND SUMMARY OF THE INVENTION

The present invention relates to an open end spinning rotor comprising a fiber guiding inner surface with a wear resistant surface layer, wherein said inner surface comprises a fiber sliding surface adjacent to a fiber collecting groove. According to the present invention, the fiber collecting groove has a greater frictional resistance with regard to the spinning fibers than the fiber sliding surface.

An open end spinning rotor is disclosed in Lang, et al. Published German Patent Application No. DE 43 05 626, wherein the fiber guiding inner surface of the spinning rotor has a nickel-diamond coating, which provides the required gripping effect in the fiber collecting groove. The desired roughness of the fiber collecting groove is caused by individual diamond particles projecting outward from the coating. In order to reduce the frictional resistance of the fiber sliding surface, it is smoothed after coating in a subsequent treatment step. During this smoothing treatment, the projecting diamond particles are pulled out, which results in the fiber sliding surface losing the here undesired gripping effect.

The purpose of reducing the frictional resistance of the fiber sliding surface is to enable the spinning fibers to slide, by means of centrifugal forces, as easily as possible into the fiber collecting groove. The fibers should stop sliding at the point of entry into the fiber collecting groove, as the fibers should have at this point in time achieved the circumferential speed of the spinning rotor. This is why the frictional resistance of the fiber collecting groove should be greater than the friction resistance of the fiber sliding surface relative to the spinning fibers.

However, the nickel-diamond coating, while technically particularly suitable for the fiber collecting groove, does not have a sufficiently long life. Therefore, a deterioration in spinning results is seen after a relatively short time when a nickel-diamond coating is used. It is thus an object of the present invention to increase the wear resistance of the fiber guiding inner surface while still providing for the varying frictional resistance of the different surfaces.

This object of the present invention is achieved by providing a surface layer consisting of iron boride wherein the fiber collecting groove has a specially structured surface.

Contrary to DE 43 05 626, mentioned above, where a suitable coating is chosen for the fiber collecting groove and the fiber sliding surface is then treated subsequently, the procedure for making the spinning rotor of the present invention is different. According to the present invention, an extremely resistant but sufficiently smooth layer is chosen first for the fiber sliding surface, and then the fiber collecting groove is made to grip in the desired way before or after by means of an additional procedure.

Raasch, et al. U.S. Pat. No. 4,663,929 (counterpart of Published German Patent Application No. 34 29 511) discloses that spinning rotors made of steel with a boronized inner surface are also provided with erosion craters on the fiber sliding surface and/or the fiber collecting groove, which can be created by spark erosion, particle accelerators or laser beams. U.S. Pat. No. 4,663,929 does not disclose, however, that it is advantageous for the fiber sliding surface and the fiber collecting groove to have a different frictional resistance relative to the spinning fibers, such that the fiber collecting groove should be constructed to grip more than the fiber sliding surface.

According to the present invention, the entire fiber guiding inner surface of the spinning rotor is extremely wear resistant, with the fiber sliding surface and the fiber collecting groove each adapted to their different respective spinning functions. At the outset, the fiber sliding surface is sufficiently smooth due to boronizing of the steel spinning rotor, which enables the fibers to slide into the fiber collecting groove by means of centrifugal forces, while the fiber collecting groove is constructed with sufficient grip so that the fibers can attain the circumferential speed of the spinning rotor. This is advantageous for spinning rotors with particularly small diameters which are currently used for high speeds. Smaller spinning rotors require steeper fiber sliding surfaces with less frictional resistance than the traditionally larger spinning rotors. The type of layer or surface treatment of the fiber guiding inner surface can be adapted to suit the requirements of the fiber sliding surface, while the requirements of the fiber collecting groove can be met by an additional treatment.

In a preferred embodiment, this special structure is created by a roughening of the already boronized surface layer, carried out preferably by means of lasers. Laser beams are capable of changing even an extremely hard surface layer, even such as one arising from a boronizing process. Another preferred embodiment involves subsequent mechanical roughening.

In another preferred embodiment, the structure is first roughened mechanically, preferably by roll pressing, before boronizing. As such, the fiber collecting groove is made to grip in the desired way before the surface layer is hardened by boronizing. The subsequent step of boronizing does not change the form of the fiber collecting groove, as an additional layer is not applied, but rather the surface layer is transformed.

Other objects, advantages and novel features of the present invention will become apparent from the following detailed description of the invention when considered in conjunction with the accompanying drawings.

BRIEF DESCRIPTION OF THE DRAWINGS

FIG. 1 is an axial cross-sectional view of an open end spinning rotor constructed according to preferred embodiments of the present invention;

FIG. 2 is an enlarged section of the fiber sliding surface area of the spinning rotor of FIG. 1, wherein the fiber collecting groove has been subsequently treated with laser beams;

FIG. 3 is an enlarged section of the fiber collecting groove area of the spinning rotor of FIG. 1, wherein the fiber collecting groove has been subsequently treated with laser beams;

FIG. 4 is an enlarged section of the fiber sliding surface area of the spinning rotor of FIG. 1, wherein the fiber collecting groove has been given a special structure before boronizing by means of roll pressing;

FIG. 5 is an enlarged section of the fiber collecting groove area of the spinning rotor of FIG. 1, wherein the fiber collecting groove has been given a special structure before boronizing by means of roll pressing;

DETAILED DESCRIPTION OF THE PREFERRED EMBODIMENT

Figure 6:
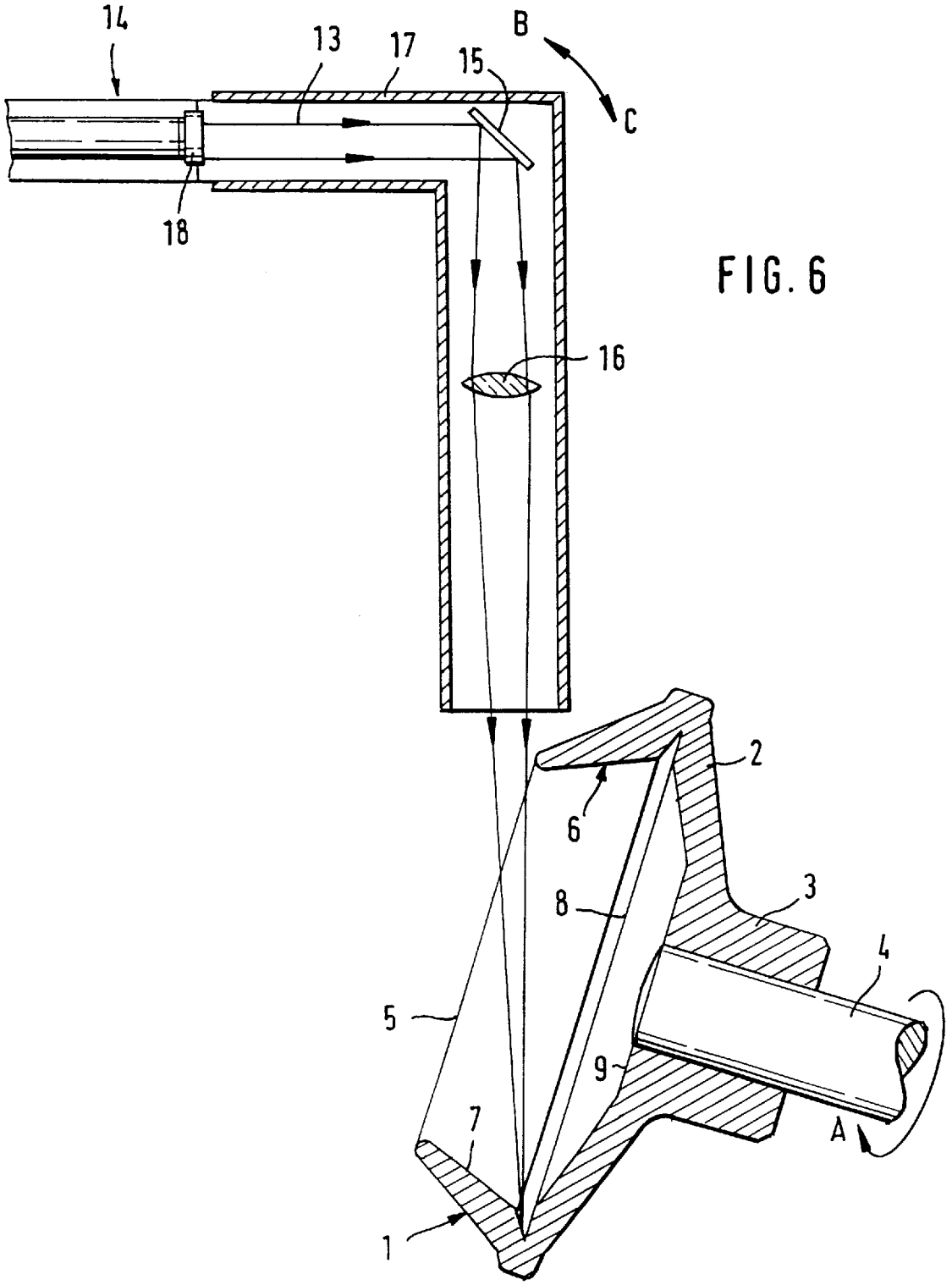
FIG. 6 is a schematic representation of the treatment of the fiber collecting groove of a spinning rotor with laser beams.

The spinning rotor assembly 1 as shown in FIG. 1 comprises a rotor 2 as well a rotor shaft 4 pressed into a bore hole of a ring collar 3 of the rotor 2. It is noted that the bearings and drive of the spinning rotor assembly 1 as well as the functional parts connected thereto are not shown, but are familiar to those skilled in the art.

According to FIG. 1, from an open front side 5, the hollow rotor 2 comprises a fiber guiding inner surface 6, which in turn comprises a fiber sliding surface 7 adjacent to a fiber collecting groove 8. The latter is followed by a rotor base 9. The fiber sliding surface 7 widens conically, starting from the open front side 5, towards the fiber collecting groove 8, at which point it has the largest diameter of the fiber guiding inner surface 6.

Separated single fibers are fed during the spinning process onto the fiber sliding surface 7, from where they slide into the fiber collecting groove 8 as a result of the centrifugal forces produced by the spinning rotor assembly 1, by which time they should have attained the circumferential speed of the rotor 2. Therefore, the fiber guiding inner surface 6 in the area of the fiber sliding surface 7 has less frictional resistance relative to the spinning fibers than in the area of the fiber collecting groove 8, which should be made to grip sufficiently.

Despite the different technical requirements of the surface condition of the fiber sliding surface 7 and the fiber collecting groove 8, the entire fiber guiding inner surface 6 should be sufficiently wear resistant so that the rotor 2 maintains a satisfactorily long life. The rotor 2 is therefore made of steel and boronized, at least on the fiber guiding inner surface 6. Boronizing takes place, not by application of an additional coating, but rather by a structural transformation of the surface, without altering the form of the rotor 2.

From the enlarged section in FIG. 2, it can be seen that in the case of the fiber sliding surface 7, the surface layer 10 is of iron boride. It should be noted that, the increased number of section lines of the surface layer 10 indicate a structural transformation of the surface without any change in dimension and not an application of an additional material coating.

In a preferred embodiment, the thickness of the surface layer 10 is about 20 $\mu$m. The fiber sliding surface 7 appears to be very smooth in the schematic representation in FIG. 2, although in reality, a certain surface roughness is, of course, present.

In contrast to FIG. 2, in the enlarged section of a fiber collecting groove 8 shown in FIG. 3, a special structure 11 has been applied to the previously boronized surface, which lies within the micrometer range but which is, however, significantly rougher than the surface of the fiber sliding surface 7. The comparison of the schematic representations in FIGS. 2 and 3 are to demonstrate that the frictional resistance relative to the spinning fibers, is much greater at the fiber collecting groove 8 than at the fiber sliding surface 7. The structure 11 of the surface of the boronized rotor 2 can be produced by means of laser beams.

While the structure 11 in FIGS. 2 and 3 was applied in a subsequent procedure, in FIGS. 4 and 5, a structured surface 12 is created in the fiber collecting groove 8 before boronizing. In this case, the section in FIG. 4, which represents an area of the fiber sliding surface 7, is identical to the section shown in FIG. 2. However, in the case of the fiber collecting groove 8, the structure 12 shown in FIG. 5 is applied before boronization, so that this structured form continues inside the wall at the transition point from iron boride to steel. The fiber guiding surface of the fiber collecting groove 8 is not, however, altered by subsequent boronizing. The structured surface 12 can be created by means of roll pressing before boronizing.

FIG. 6 shows schematically how a boronized fiber guiding inner surface 6 can be provided with a structured surface 11 in the area of the fiber collecting groove 8. The spinning rotor assembly 1 is hereby supported at rotor shaft 4 in a bearing (not shown) which is stable yet rotatable, so that it can be rotated in arrow direction A at a desired slow speed. A laser beam 13 from a laser 14 is aimed at an angle to the boundary walls of the fiber collecting groove 8. The laser beam 13 is deflected by a corner reflector 15 at an approximate right angle and compressed by a lens 16 to such an extent that it directly hits a point on the fiber collecting groove 8. The path of the laser beam 13 is surrounded by a protective tube 17, so that the laser beam 13 is not subject to any interference.

In one example, the laser beam 13 has a diameter of 22 mm through the one-way lens 18, and a diameter of about 30 mm at the lens 16. The one-way lens 18 has a reflection factor of approximately 95%. The laser beam 13 is aimed through the lens 16 exactly at the desired point on the fiber collecting groove 8 due to its width. The corner reflector 15 and the lens 16 can be adjusted minimally by means of devices (not shown) in arrow directions B and C. As the rotor 2 can be rotated slowly in arrow direction A, all points on the fiber collecting groove 8 can be reached by the laser beam 13. The rotational speed of the rotor 2 depends on the degree of structured surface 11 on the previously boronized fiber collecting groove 8.

The concentrated, strong laser beam 13 is capable of roughening the iron boride on the surface of the fiber collecting groove 8.

Figure 7:
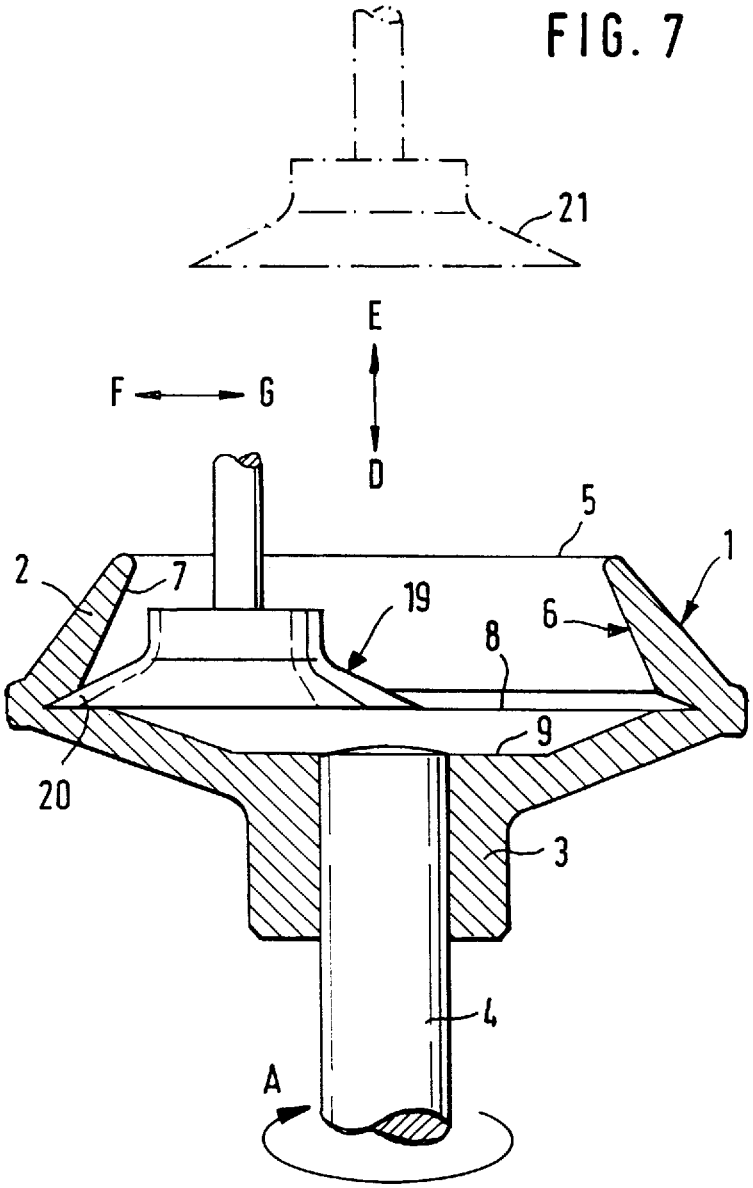
FIG. 7 is a schematic representation of the treatment of the fiber collecting groove by means of roll pressing.

According to the schematic representation in FIG. 7, a structured surface 12 is applied to the fiber collecting groove 8 before the fiber guiding inner surface 6 of the rotor 2 is boronized. This can be done, for example, by a die or press roller 19, whose contour 20, in the area of its working surface, is adapted to match the form of the fiber collecting groove 8. The die roller 19 has at this point its largest diameter, which is smaller than the diameter of the open front side 5 of the rotor 2. This enables the die roller 19 to be guided along arrow directions D and E from its non-operational position, represented by a dot-dash line, into its operational position, represented by a continuous line. The axle can be adjusted laterally to the rotor shaft 4 in the direction of arrows F and G by a device (not shown).

The surface of the die roller 19 in the area of the contour 20 is preferably a little rough, so that the fiber collecting groove 8 can be provided with the desired structured surface 12. When the surface of the fiber guiding inner surface 6 is subsequently boronized, the construction of the fiber collecting groove 8 is not altered.

It is, of course, possible to create the structured surface shown in FIG. 6 or 7, either before or after boronizing, by means other than those mentioned above. The examples of the laser 14 and the die roller 19 only represent preferred methods.

According to the present invention, a wear resistant surface layer 10 can be chosen, which already possesses the necessary roughness for the fiber sliding surface 7, while the frictional resistance of the fiber collecting groove 8, in relation to the spinning fibers, can be achieved by means of an additional procedure.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. An open end spinning rotor comprising a fiber guiding inner surface with a wear resistant surface layer for feeding fibers, wherein said fiber guiding inner surface comprises a fiber sliding surface adjacent to a fiber collecting groove, wherein the fiber collecting groove has a greater frictional resistance than the fiber sliding surface relative to the fed fibers, and wherein the wear resistant surface layer consists of iron boride and the fiber collecting groove has a roughened surface.

2. The open end spinning rotor according to claim 1, wherein the wear resistant surface layer has a thickness of about 20 $\mu$m.

3. The open end spinning rotor according to claim 1, wherein the roughened surface of the fiber collecting groove is created by roughening the wear resistant surface layer.

4. The open end spinning rotor according to claim 3, wherein the wear resistant surface layer is roughened by laser beam.

5. The open end spinning rotor according to claim 1, wherein the roughened surface of the fiber collecting groove is created by roughening with a mechanical procedure before the wear resistant surface layer is created.

6. The open end spinning rotor according to claim 5, wherein the roughened surface is created by roughening with a die roller.

7. A method of making an open end spinning rotor with a fiber guiding inner surface for feeding fibers, comprising the steps of:

boronizing the inner surface to create a wear resistant surface layer comprising a fiber sliding surface area adjacent to a fiber collecting groove area, and subsequently roughening the wear resistant surface layer in the fiber collecting groove area to create a roughened surface so that the fiber collecting groove area has a greater frictional resistance than the fiber sliding surface area relative to the fed fibers.

8. The method of making an open end spinning rotor according to claim 7, wherein the roughening includes applying laser beam onto the wear resistant surface layer.

9. A method of making an open end spinning rotor with a fiber guiding inner surface for feeding fibers, comprising the steps of:

mechanically roughening the inner surface to create a fiber collecting groove area with a roughened surface so that the fiber collecting groove area has a greater frictional resistance than an adjacent fiber sliding surface area relative to the fed fibers, and subsequently boronizing the inner surface to create a wear resistant surface layer for the fiber sliding surface area and the fiber collecting groove area without altering the roughened surface of the fiber collecting groove area.

10. The method of making an open end spinning rotor according to claim 9, wherein the mechanical roughening includes forcing a die roller against the inner surface of the fiber collecting groove area.

11. A method of making an open end spinning rotor with a fiber guiding inner surface including a fiber sliding surface area adjacent to a fiber collecting groove area, comprising the steps of:

providing the inner surface with a wear resistant surface layer, and roughening the fiber collecting groove area either before or after the providing the inner surface step to have a greater frictional resistance than the fiber sliding surface area.

12. The method of making an open end spinning rotor according to claim 11, wherein the wear resistant surface layer is provided before the roughening.

13. The method of making an open end spinning rotor according to claim 12, wherein the roughening includes applying a laser beam to the fiber collecting groove area.

14. The method of making an open end spinning rotor according to claim 11, wherein the wear resistant surface layer is provided after the roughening.

15. The method of making an open end spinning rotor according to claim 14, wherein the roughening includes forcibly applying a mechanical die roller to the fiber collecting groove area.

16. The method of making an open end spinning rotor according to claim 11, wherein the step of providing the wear resistant surface layer includes boronizing the inner surface.

* * * * *